United States Patent [19]

Saito

[11] Patent Number: 4,573,390

[45] Date of Patent: Mar. 4, 1986

[54] PLAY DATA DETECTING SYSTEM FOR ELECTRONIC MUSICAL INSTRUMENTS

[75] Inventor: Tsutomu Saito, Shizuoka, Japan

[73] Assignee: Kabushiki Kaisha Kawai Gakki Seisakusho, Japan

[21] Appl. No.: 694,203

[22] Filed: Jan. 24, 1985

Related U.S. Application Data

[63] Continuation of Ser. No. 465,056, Feb. 9, 1983, abandoned.

[30] Foreign Application Priority Data

Feb. 15, 1982 [JP] Japan ..... 57-22244

[51] Int. Cl.[4] ..... G10H 1/18

[52] U.S. Cl. ..... 84/115; 84/1.01; 84/345; 340/365 S

[58] Field of Search ..... 84/1.01, 1.24, 115, 84/345; 340/365 S

[56] References Cited

U.S. PATENT DOCUMENTS 4,215,619 8/1980 Budelman et al. ..... 84/1.24 X
4,294,155 10/1981 Turner ..... 84/1.01
4,343,216 8/1982 Swain et al. ..... 84/1.01

*Primary Examiner*—Stanley J. Witkowski
*Attorney, Agent, or Firm*—McGlew and Tuttle

[57] ABSTRACT

A play data detecting system for an electronic musical instrument in which in the case of multiplexing together and scanning note select signals from key switches and function select signals from tablet switches and analog volumes, these signals are divided into a plurality of scan blocks of different scan periods. For the tablet switches, a processing routine is executed twice in one cycle of a main routine in view of a required number of scan addresses and, for the analog volumes, the results of parallel processing are used once in one cycle. This permits high-speed processing of the key switches and low-speed processing of the tablet switches and the analog volumes with sampling periods fit for them, respectively.

2 Claims, 7 Drawing Figures

KDA MAIN ROUTINE
A/D CONVERSION START SIGNAL
COMPARATOR INPUT SIGNALS
COMPARATOR OUTPUT
KS
EAVMTTSS
5V
4
3
2
1
0V

PLAY DATA DETECTING SYSTEM FOR ELECTRONIC MUSICAL INSTRUMENTS

This is a continuation of application Ser. No. 465,059 filed Feb. 9, 1983 and now abandoned.

BACKGROUND OF THE INVENTION

1. Field of the Invention

The present invention relates to a play data detecting system for an electronic musical instrument which is provided with means for multiplexing together and scanning note select signals from key switches and function select signals from tablet switches and analog volumes.

2. Description of the Prior Art

Heretofore there has been proposed, for instance, in U.S. Pat. No. 4,046,047 (patented Sept. 6, 1977) a system for multiplexing and scanning note select signals from key switches and function select signals from tablet switches and analog volumes on the same line. With the abovesaid prior art system, however, the key switch signal and the tablet switch signal are each assigned only once in one scanning period and the tablet switch signal is sampled more than necessary.

Recently there has been widely used a play data detector of the type employing a microcomputer but, in the case of using such a sequential control element, the length of the processing time is a very important problem. That is to say, in the case where the key switch signal and the tablet switch signal are each assigned only one time slot in one scanning period as in the prior art, it may sometimes be difficult to follow the speed of play data in a block which requires high-speed sampling, such as block of key switches. This arises from equally handling the key switch signal which must be sampled at high speed and the tablet switch signal which may be sampled at relatively low speed.

SUMMARY OF THE INVENTION

It is an object of the present invention to provide a play data detecting system for electronic musical instruments which permits multiplexing note select signals and function select signals and sampling them with speeds just enough for both of them, respectively.

According to the present invention, the play data detecting system for an electronic musical instrument, which is equipped with means for multiplexing and scanning note select signals from key switches and function select signals from tablet switches and analog volumes, is characterized in that the signals are divided into a plurality of scanning blocks of different scanning speeds. For the tablet switches, a processing routine is executed twice in one cycle of a main routine in consideration of a required number of scan addresses and, for the analog volumes, the results of parallel processing are input once in a cycle of the main routine. This permits high-speed processing of the key switches and low-speed processing of the tablet switches and analog volumes with sampling speeds fit for them, respectively.

DESCRIPTION OF THE PREFERRED EMBODIMENTS

Figure 1:
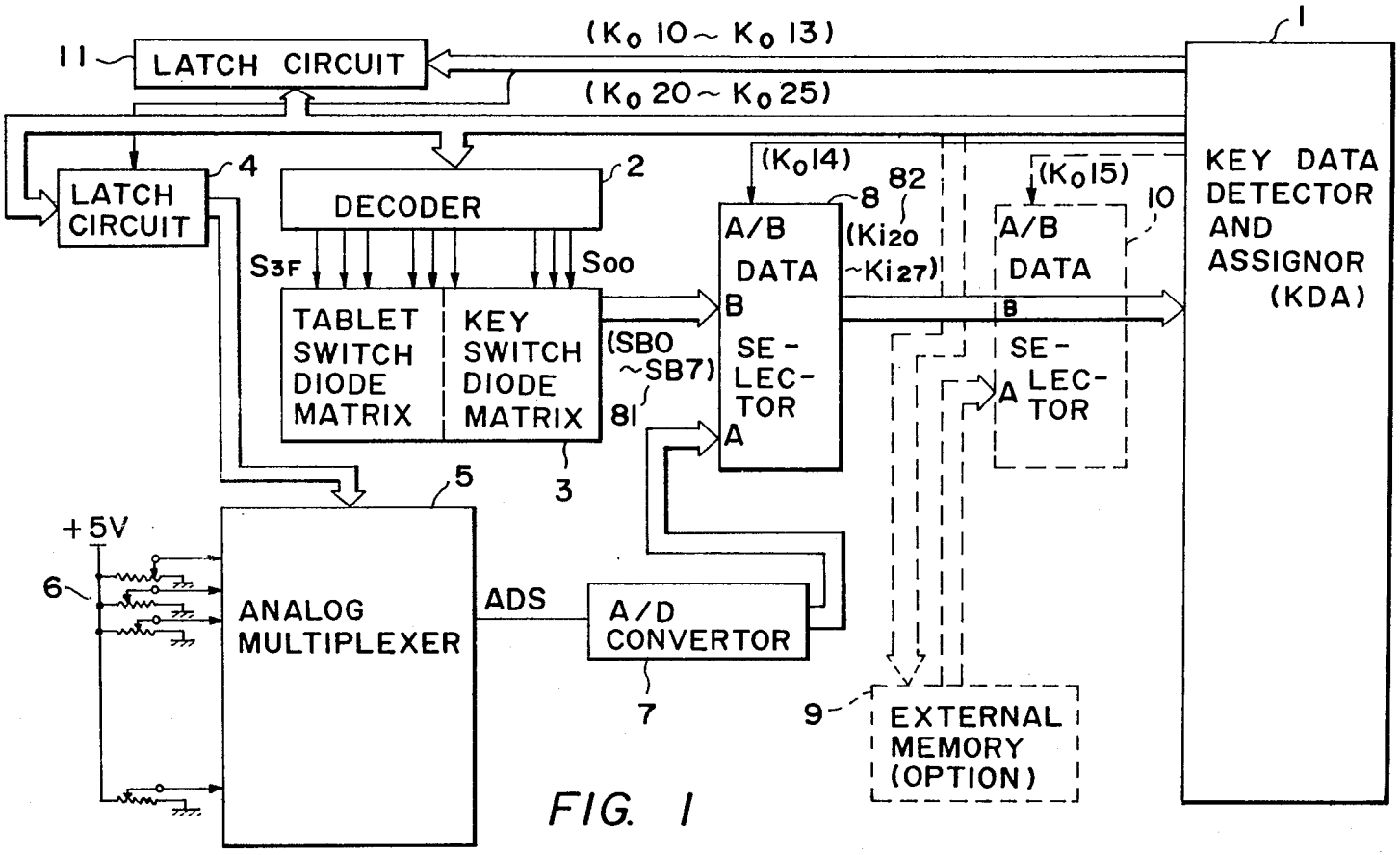
FIG. 1 is a block diagram illustrating the arrangement of an embodiment of the present invention.

FIG. 1 is explanatory of the arrangement of an embodiment of the present invention, illustrating in block form a key data detector and assignor (KDA) 1 of an electronic organ and associated parts. In FIG. 1 scan signals (Ko20 to Ko25) are output from the key data detector and assignor (KDA) 1. These signals are applied to a decoder 2, from which scan addresses ($S_{00}$ to $S_{3F}$) described later are provided to a key switch and tablet switch diode matrix 3, providing signals SB0 to SB7 indicated by 81. The bus on which the signals SB0 to SB7 are provided is held high-level and when a key switch or tablet switch is dispressed a key switch signal or tablet switch signal becomes low-level and is input to a data selector 8 via a corresponding one of signal lines 81 (SB0 to SB7). An output bus signal 82 (Ki20 to Ki27) of the data selector 8 is applied directly to the key data detector and assignor (KDA) 1 when an optional external memory (EM) 9 is not connected. In the case where the optional external memory (EM) 9 is connected, broken-line parts are added and the output 82 (ki20 to ki27) of the data selector 8 is provided via another stage of a data selector 10 to the key data detector and assignor (KDA) 1.

Data of analog volumes, such as the value of a draw bar and a sustain time, are input to the key data detector and assignor (KDA) 1 by applying thereto via an A/D converter 7 an analog value obtained at a voltage 0 to 5 V. That is, the voltage value 0 to 5 V set by volumes 6 are provided to an analog multiplexer 5 and an analog multiplexer control signal is provided on the bus (Ko20 to Ko25) of the key data detector and assignor (KDA) 1 and latched by a latch circuit 4. By the latch output a corresponding voltage ADS is provided from the analog multiplexer 5 to the A/D converter 7, wherein it is converted into a digital signal, thereafter being applied to the data selector 8. In the data selector 8 either one of the signal (A) from the A/D converter 7 and the signal (SB0 to SB7) (B) from the diode matrix 3 is selected by a select signal (Ko14) from the key data detector and assignor (KDA) 1.

On the bus (Ko20 to Ko25) of the key data detector and assignor (KDA) 1 are provided lamp data to be displayed on a panel in addition to the aforementioned scan address ($S_{00}$ to $S_{3F}$) and the analog multiplexer control signal, and the lamp data is latched by a latch signal (Ko10 to Ko13) in a latch circuit 11 and its output is applied to a lamp driver to light a lamp.

Figure 2A:
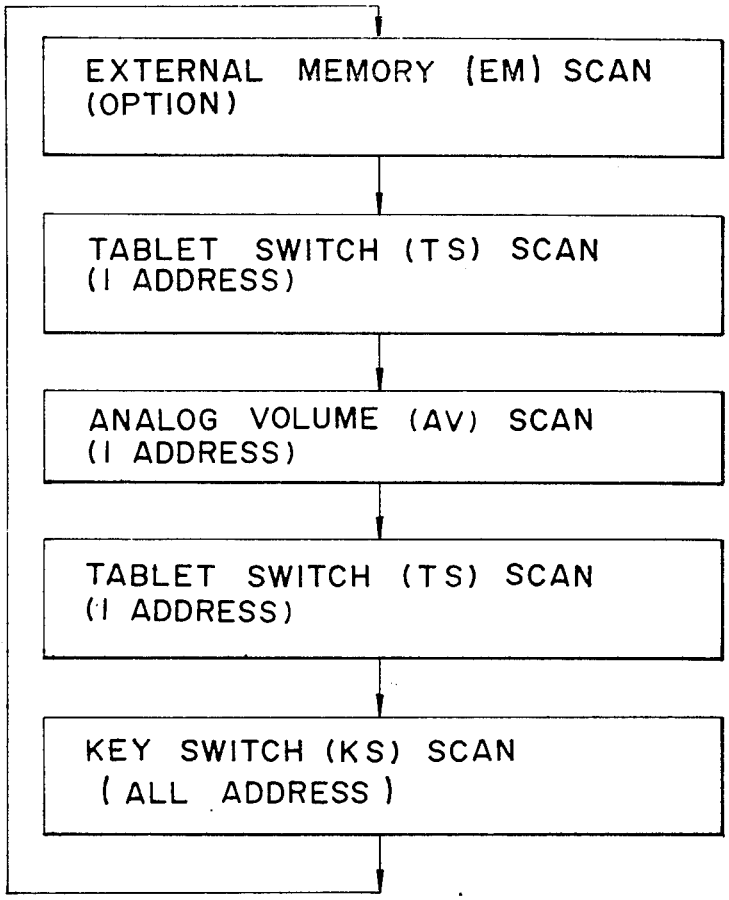
FIGS. 2A and 2B are explanatory of the principal part of the present invention.
Figure 2B:
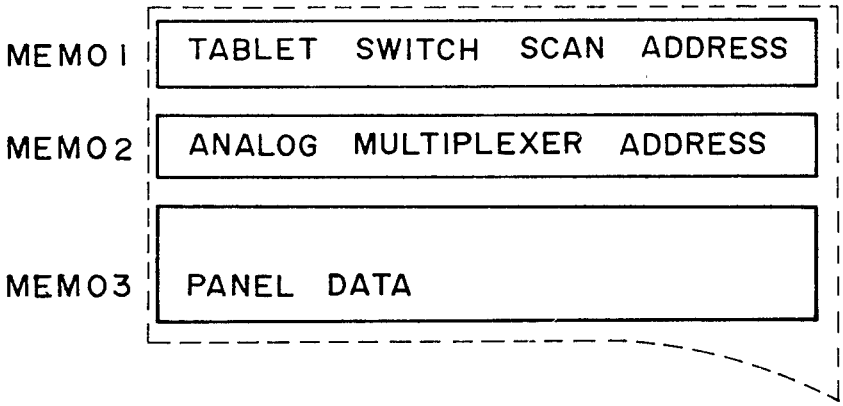

The key data detector and assignor (KDA) 1 is formed by a microcomputer and various data provided thereto from the key switches, the tablet switches, the analog volumes and the optional external memory are subjected to sequential control through sing scan addresses and a data selector control signal. FIG. 2A shows a main routine for the sequential control and FIG. 2B is explanatory of working memories needed therefor.

The main routine shown in FIG. 2A includes four subroutines, i.e. an external memory (EM) scan, a tablet switch (TS) scan, an analog volume (AV) scan and a key switch (KS) scan and, in this case, the tablet switch (TS) scan is applied twice.

The external memory (EM) scan is to check data transmission and reception. For example, between a nonvolatile memory and a device formed by a magnetic card outside the panel. If the optional external memory (EM) is not connected to the electronic organ, the external memory (EM) scan is unnecessary and even if it is connected, no processing takes place and the operation returns to the main routine unless the optional external memory (EM) requests the electronic organ to send and receive data. The external memory (EM) scan is also constituted by time division multiplexing on the same bus of the key data detector and assignor (KDA) 1 as the aforementioned various data.

The tablet switch (TS) scan is a subroutine that scans one address in a plurality of function tablet addresses and defect tablet addresses indicated by scan addresses $S_{28}$ to $S_{3E}$ of the tablet switches in Table 1. For scanning the next address by the next scan, a working memory MEMO 1 shown in FIG. 2B is provided for storing the address.

TABLE 1

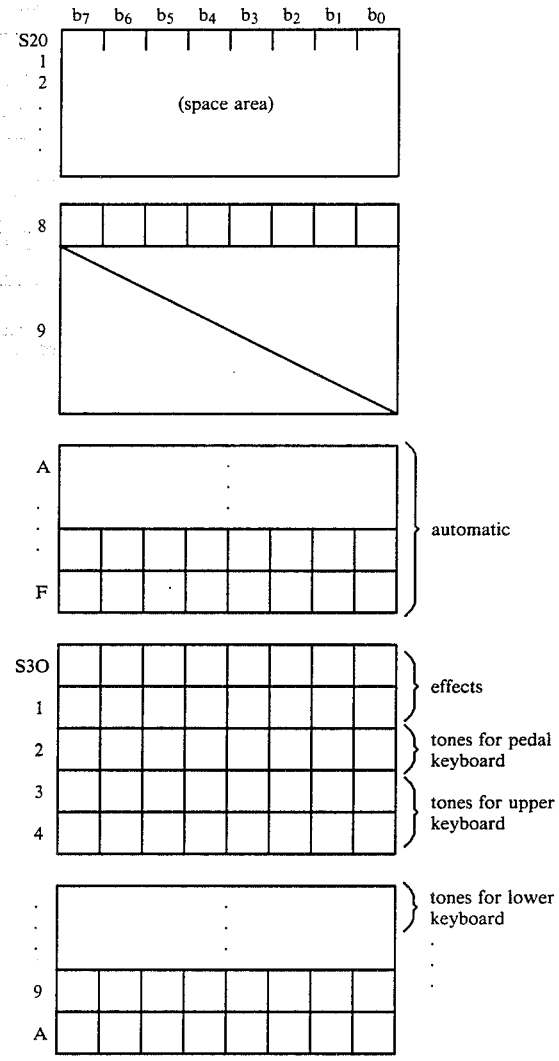

TABLE 1-continued

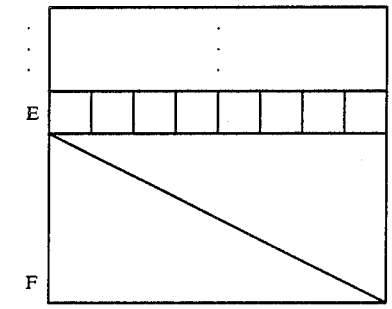

The analog volume (AV) scan is a subroutine that converts to digital form analog volume data of one address of various draw bar controls indicated by multiplexer addresses $M_{01}$ to $M_{24}$ in Table 2. For selecting the next address by the next scan, a working memory MEMO 2 shown in FIG. 2B is provided for storing the address.

TABLE 2

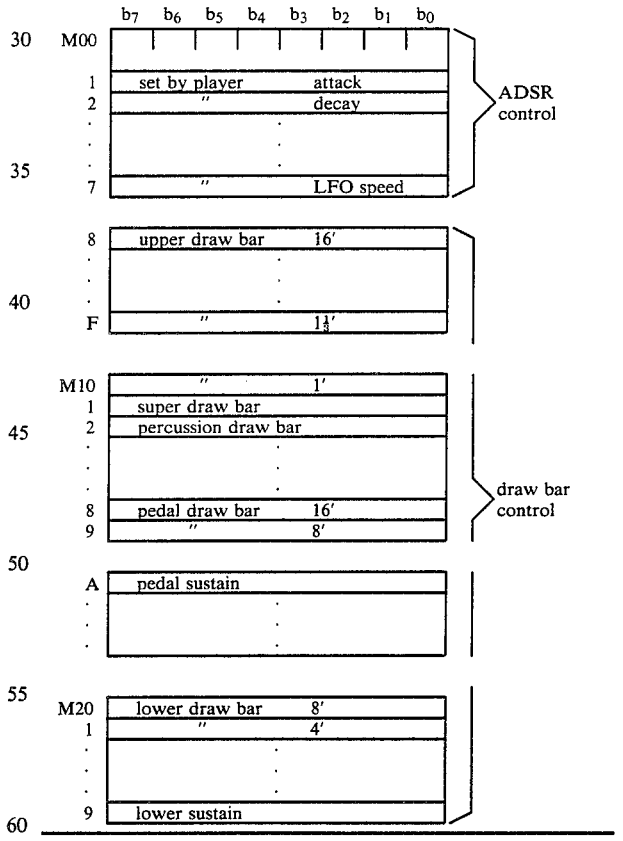

The key switch (KS) scan is a subroutine that scans all key addresses of upper, lower and pedal keyboards indicated by key switch scan addresses $S_{00}$ to $S_{17}$ in Table 3. Panel data MEMO 3 in FIG. 2B is a memory for storing various panel data.

TABLE 3

| | $b_7$ | $b_6$ | $b_5$ | $b_4$ | $b_3$ | $b_2$ | $b_1$ | $b_0$ | |
|---|---|---|---|---|---|---|---|---|---|
| S00 | | F | E | D# | D | C# | $C_6$ | | upper keyboard |
| 1 | | B | A# | A | G# | G | F# | | |
| 2 | | F | E | D# | D | C# | $C_5$ | | |
| 3 | | B | A# | A | G# | G | F# | | |
| . . . | | | | | . . . | | | | |
| 8 | | F | E | D# | D | C# | $C_2$ | | |
| 9 | $C_1$ | B | A# | A | G# | G | F# | | |
| A | | F | E | D# | D | C# | $C_5$ | | |
| . . . | | | | | . . . | | | | |
| F | | B | A# | A | G# | G | F# | | |
| S10 | | F | E | D# | D | C# | $C_3$ | | lower keyboard |
| 1 | $C_3$ | B | A# | A | G# | G | F# | | |
| 2 | | F | E | D# | D | C# | $C_2$ | | |
| 3 | $C_1$ | B | A# | A | G# | G | F# | | |
| 4 | | F | E | D# | D | C# | $C_3$ | | pedal keyboard |
| | | | | | | | | | |
| 7 | $C_1$ | B | A# | A | G# | G | F# | | |
| | | | | | | | | | |

Now, a detailed description will be given of the analog volume scan.

Data of the tablet switches TS and the key switches KS are formed by the diode matrix 3, whereas analog volume data is already time-division multiplexed before application to the A/D converter 7, and its conversion time is in the range of several tens of microseconds to several milliseconds when a general purpose A/D converter is used. If the key data detector and assignor (KDA) 1 is held in a standby state during the operation of the A/D converter, then the time necessary for one cycle of the main routine increases, introducing the possibility that the actual play by the player cannot be followed up. To avoid this, according to the system of the present invention, during the operation of the A/D converter 7, a control terminal A/B of the data selector 8 is held on the side B to input thereinto the data of the tablet switches TS and the key switches KS. Accordingly, the control terminal A/B of the data selector 8 is connected to the side A only at the timing of inputting the A/D converted data in the subroutine of the analog volume (AV) scan.

FIGS. 3(*a*) to (*d*) show the relation between the flow of the main routine of the key data detector and assignor (KDA) 1 and the processing time for the abovesaid A/D conversion. FIG. 3(*a*) shows the execution of the subroutines of the external memory (EM) scan, the tablet switch (TS) scan, the analog volume (AV) scan, the tablet switch (TS) scan and the key switch (KS) scan in the order described previously in connection with FIG. 2(*a*). In this case, the analog volume (AV) is subjected to A/D conversion concurrently with other scans after the previous analog volume scan and the resulting data is input in the time slot of the analog volume (AV).

Figures 3A, 3B, 3C, 3D:
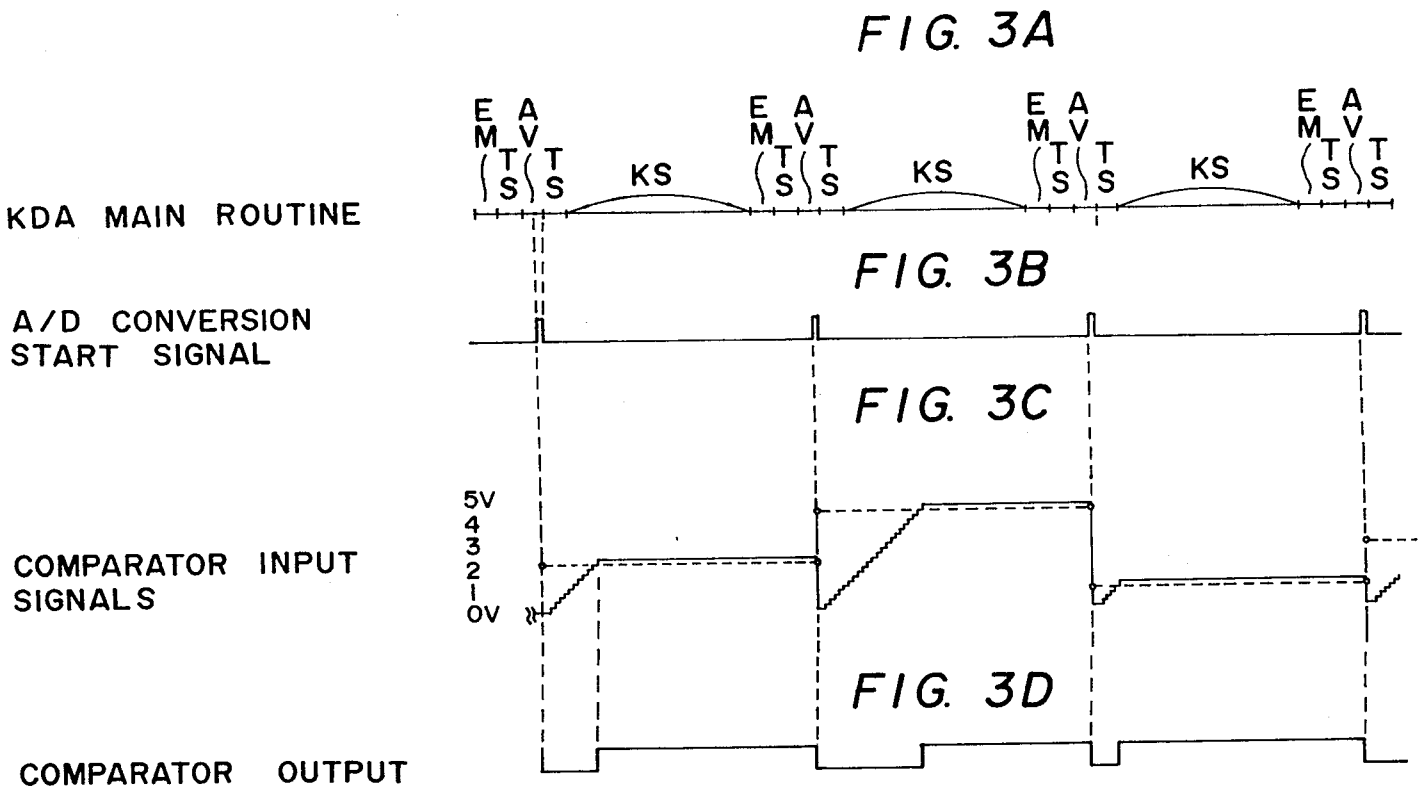
FIGS. 3A to 3D are waveform diagrams explanatory of operations of the principal part of the present invention.

That is to say, by the rise of an A/D conversion start signal shown in FIG. 3(b) an analog volume multiplexer address is latched in the latch circuit 4 in FIG. 1 and the A/D converer 7 is also reset. Upon the fall of the A/D conversion start signal, the A/D vonverter 7 starts and when a stairstepshaped comparator input signal indicated by the solid line in FIG. 3(*c*) coincides with the other comparator input signal (ADS) indicated by the broken line in FIG. 3(*c*), a comparator output value in FIG. 3(*d*) changes from a "0" to a "1" and the A/D converter 7 is locked. The main routine of the key data detector and assignor (KDA) receives the data locked in the A/D converter 7 in the subroutine of the analog volume (AV) scan.

According to this system, if one cycle of the main routine of the key data detector and assignor (KDA) 1 is selected to be 2 ms, then the period for scanning the key switches is 2 ms. Since the tablet switch (TS) addresses are 23 addresses $S_{28}$ to $S_{3E}$ as shown in Table 1 and since the subroutine of the tablet switch (TS) scan is inserted twice in one cycle of the main routine, the period for scanning the tablet switches (TS) is 2(ms)×23(addresses)÷2(times)=23 ms. The period for scanning the analog volume 6 is 2(ms)×36(addresses)÷1(time)=72 ms since the analog volume multiplexer addresses are 36 addresses $M_{01}$ to $M_{24}$ as shown in Table 2 and since the subroutine of the analog volume (AV) scan is inserted once in one cycle of the main routine.

In this way, the tablet switches and the analog volume can be scanned with speeds or a number of samplings fit for them, respectively, by inserting, for the former, a processing routine twice in one cycle of the main routine in view of the number of scan addresses and by using, for the latter, the results of parallel processing after the previous processing routine in consideration of the time for A/D conversion.

As has been described in the foregoing, according to the present invention, in the case of multiplexing and scanning note select signals from key switches and function select signals from tablet switches and an analog volume, these signals are divided into a plurality of scan blocks of different scan speeds. For the tablet switches, a processing routine is inserted twice in one cycle of a main routine in relation to the number of addresses required and, for the analog volume, the results of parallel processing after the previous processing routine are used; this permits high-speed processing of the key switches and low-speed processing of the tablet switches and the analog volume with sampling speeds fit for them, respectively.

It will be apparent that many modifications and variations may be effected without departing from the scope of the novel concepts of the present invention.

What is claimed is:

1. A key detect and assignor system for an electronic musical instrument which is provided with: means for sending a scan address to a key switch diode matrix or tablet switch diode matrix to obtain switch information; means for multiplexing a plurality of analog volumes; means for A/D converting the output of the multiplexing means to obtain A/D converted information; means for producing a scanning main routine housing repeating cycles; and means for selecting either one of the switch information and the A/D converted information; wherein during one cycle of the main routine, key switches of all addresses, tablet switches of only some addresses, and only one analog volume are scanned.

2. A key detect and assignor system according to claim 1, which has a subroutine for scanning the key switches of all the addresses, a subroutine for scanning the tablet switch of one address and a subroutine for scanning one analog volume and combines the subroutines to effect all the scanning.

* * * * *